US006599396B1

(12) United States Patent
MacSween et al.

(10) Patent No.: US 6,599,396 B1
(45) Date of Patent: Jul. 29, 2003

(54) TEXTURING ROLLER IN A PAPER MACHINE

(75) Inventors: Angus MacSween, Aberdeen (GB); Austin Clark, Aberdeen (GB); Michael McCormick, Radcliffe (GB); David Lees, Radcliffe (GB)

(73) Assignee: Arjo Wiggins Fine Papers Limited, Basingstoke (GB)

( * ) Notice: Subject to any disclaimer, the term of this patent is extended or adjusted under 35 U.S.C. 154(b) by 0 days.

(21) Appl. No.: 09/979,537

(22) PCT Filed: Apr. 7, 2000

(86) PCT No.: PCT/GB00/01328

§ 371 (c)(1),
(2), (4) Date: Nov. 6, 2001

(87) PCT Pub. No.: WO00/70145

PCT Pub. Date: Nov. 23, 2000

(30) Foreign Application Priority Data

May 12, 1999 (GB) ..... 9910902

(51) Int. Cl.[7] ..... D21F 3/08; D21F 11/00

(52) U.S. Cl. ..... 162/358.1; 29/895.23; 162/361; 162/205; 162/296; 492/48

(58) Field of Search ..... 162/210, 205, 162/357, 358.1, 361, 372, 272, 296; 492/48; 29/895.23

(56) References Cited

U.S. PATENT DOCUMENTS

| | | | | |
|---|---|---|---|---|
| 3,527,668 A | * | 9/1970 | Kusters et al. | 162/358.1 |
| 3,753,276 A | * | 8/1973 | Reisch | 492/48 |
| 6,283,026 B1 | * | 9/2001 | Tocheport et al. | 492/48 |

FOREIGN PATENT DOCUMENTS

| | | | | |
|---|---|---|---|---|
| GB | 280032 | * | 3/1970 | 162/358.1 |
| SE | 403454 | | 8/1978 | |
| SE | 436717 | | 1/1985 | |
| WO | WO 91/04155 | | 4/1991 | |
| WO | WO 98/33975 | | 8/1998 | |

OTHER PUBLICATIONS

Miller Graphics (UK) Ltd "Miller Sleeve System" Brochure, (No Date).
Miller Graphics (UK) Ltd "Miller Laser" Brochure (No Date).

* cited by examiner

*Primary Examiner*—Karen M. Hastings

(57) ABSTRACT

There is disclosed a roller (10) for a texturing press on a papermaking machine adapted to be fitted with an interchangeable engraved sleeve (12) and comprising a cylindrical shell (20, 21) having a plurality of axially and circumferentially spaced apertures (23) in its peripheral surface through which pressure fluid may be ejected and at least one axially extending channel (22) within the thickness of the shell for the supply of pressure fluid to the apertures.

12 Claims, 2 Drawing Sheets

TEXTURING ROLLER IN A PAPER MACHINE

This invention concerns papermaking machinery, and more particularly a texturing press for location in the press section between the Fourdrinier and drying sections of a papermaking machine.

In a known texturing press the paper, whilst still wet, is passed through the nip between two rollers at least one of which is a surface textured rubber covered roller. A problem arises in that substantial machine downtime is required to exchange the texturing roller or rollers whenever it is desired to vary the texture imparted to the paper.

It is known in the printing industry to provide a printing roller whose bearing on one side can be swung aside (to leave the roller in cantilevered condition) enabling a sleeve having an engraved rubber outer surface covering the roller to be slid axially from the roller for exchange with another which is slid axially onto the roller. In one arrangement taught by EP 0 491 802—A the roller is provided with a plurality of axially and circumferentially spaced apertures in its peripheral surface through which pressure air may be ejected to cause slight expansion of the sleeves and an air cushion over which they may be slid. In the arrangement of EP 0 491 802–A the apertures are supplied with pressure air from a common cylindrical plenum chamber beneath the outer surface of the roller.

Such a roller would not be suitable as a texturing roller on a papermaking machine because of the very much greater nip pressures of up to 1,000 lbs per linear inch (180 Kg per linear centimetre) or more involved and the greater size whereby a common air chamber within the roller shell for all of the apertures would have such volume as to require excessive air supply to obtain the needed pressures.

According to the present invention, there is provided a roller for a texturing press on a papermaking machine adapted to be fitted with an interchangeable engraved sleeve and comprising a cylindrical shell having a plurality of axially and circumferentially spaced apertures in its peripheral surface through which pressure fluid may be ejected and at least one axially extending channel within the thickness of the shell for the supply of pressure fluid to the apertures.

There may be an individual channel for each row of apertures radially inwardly of that row.

The axially extending channels may be defined by axially extending grooves in the surface of one of two roller shells which are fitted together, one inside the other.

The grooves may be in the outer peripheral surface of the inner roller shell.

The grooves may be in the inner peripheral surface of the outer roller shell.

The roller shells may be fitted together by thermally shrinking the outer shell onto the inner shell.

The axially extending channels may be defined by bores in a single roller shell.

Each aperture may be closed by a resiliently outwardly loaded valve member protruding from the surface of the roller, engagement of a sleeve with the valve member forcing same inwardly to open the aperture.

The valve member may be a ball.

The valve member may be urged outwardly by a compression spring.

The sleeves may be of plastic with an outer cover of rubber having a laser engraved textured outer surface.

The pressure fluid may be air.

Also according to the invention is a texturing press for a papermaking machine having at least one roller as aforesaid.

Also according to the invention is a papermaking machine including a texturing press as aforesaid.

The invention also includes a method of texturing paper during its production on a papermaking machine wherein texture is imparted to the paper by a texturing press as aforesaid.

The invention will be further apparent from the following description with reference to the several figures of the accompanying drawings which show a roller embodying same.

DETAILED DESCRIPTION

Figure 1:
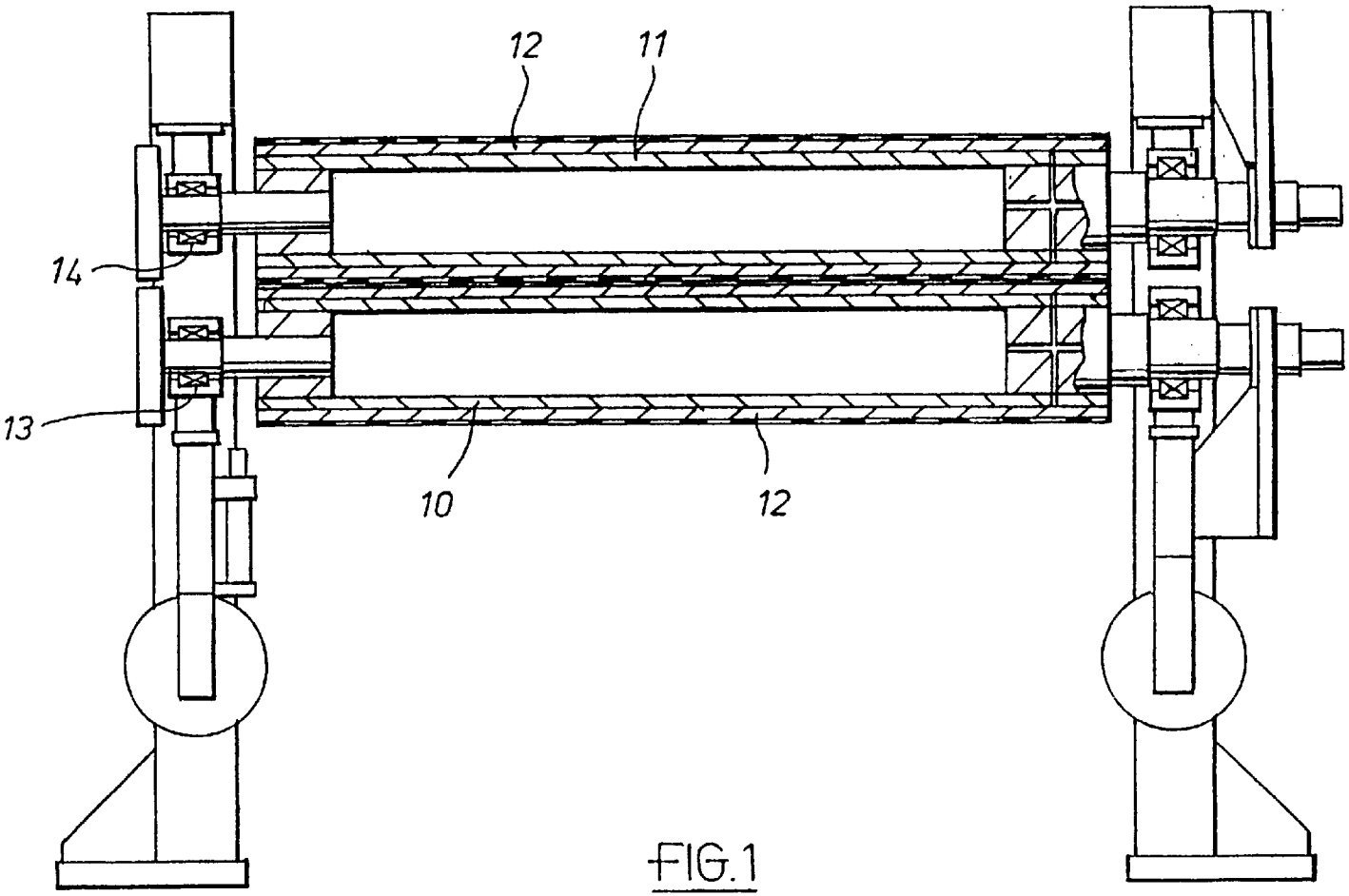
FIG. 1 shows a partially sectioned front elevation of a texturing press incorporating rollers embodying the invention.

Referring, firstly, to FIG. 1 it will be seen that the texturing press comprises a pair of rollers 10 and 11 at least one (but in this example both) of which has a covering sleeve 12 of plastics material with an outer layer of rubber having a laser engraved textured outer surface. The texturing press is located in the press section between the Fourdrinier and drying sections of a papermaking machine. Paper, whilst still wet, is passed through the nip between the rollers 10 and 11 to have the texture determined by the engraving on the sleeves 12 imparted thereto.

The sleeves 12 are interchangeable with other sleeves. The bearings 13 and 14 for the rollers 10 and 11 on one side of the press are capable of being swung aside to leave the rollers in a cantilevered condition wherein the sleeves 12 may be axially slid from and onto the roller cores.

Figure 2:
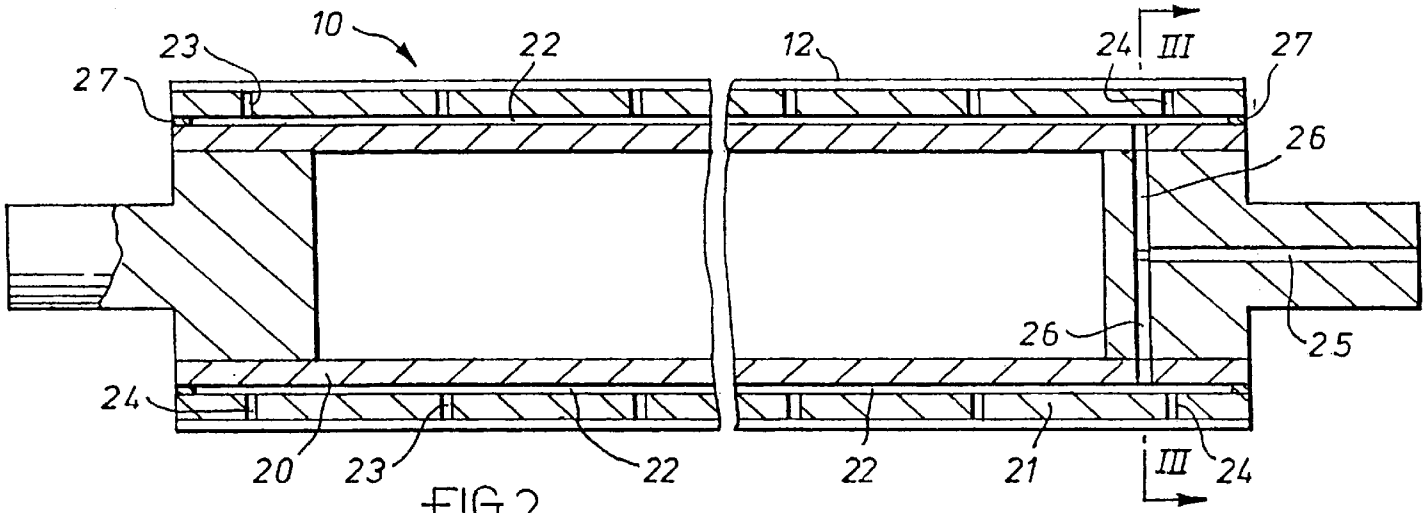
FIG. 2 shows an axial cross-section through one of the rollers of FIG. 1 on an enlarged scale.
Figure 3:
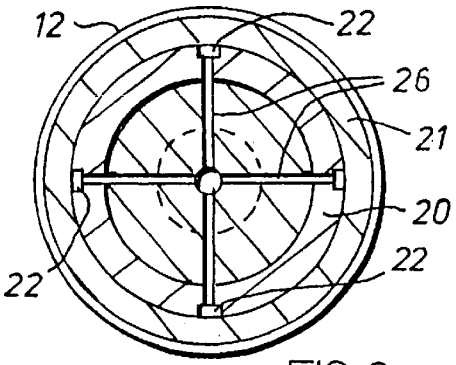
FIG. 3 shows a transverse cross-section through the roller on the line III—III of FIG. 2.

One of the rollers 10 is shown in more detail in FIGS. 2 and 3. It comprises inner and outer cylindrical roller shells 20 and 21 respectively. A plurality (four in this example) of circumferentially spaced axially extending grooves are machined into the outer peripheral surface of the inner shell 20 and the outer shell 21 is thermally shrunk onto the inner shell 20 by heating the outer shell relative to the inner shell, fitting them together and allowing them to come to ambient temperature. Four axially extending channels 22 are thus provided between the shells 20 and 21.

There are four circumferentially spaced axially extending rows of spaced apertures 23 in the outer peripheral surface of the roller 10. Each row overlies a respective one of the channels 22. A radial bore 24 connects each aperture 23 with its underlying channel 22.

Pressure air may be supplied to the apertures 23 by an axial bore in one of the axles of the roller 10. The bore 25 communicates with radial bores 26 extending to the channels 22.

The ends of the channels 22 at the opposed ends of the roller 10 are plugged as indicated at 27.

In use, when it is required to change the sleeve 12 on the roller 10, the bearing at one end of the roller is swung aside and pressure air introduced through the bore 25. Air ejected from the apertures 23 causes slight expansion of the sleeve 12 present on the roller 12 and provides a cushion of air on which the sleeve may be axially slid for replacement with a different sleeve.

Figure 4:
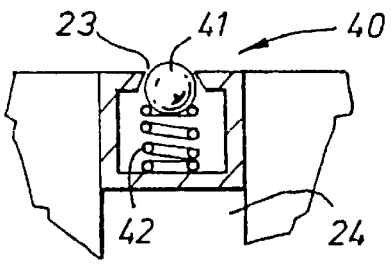
FIG. 4 shows a cross-section through one of the valves to the apertures in the surface of the roller of FIG. 2 on a further enlarged scale.

To reduce the volume of pressure air required, each aperture 23 is closed by a valve generally indicated at 40 (see FIG. 4). The valve comprises a ball 41 resiliently urged outwardly by a compression spring 42 to protrude from the outer peripheral surface of the roller 10 and close the aperture 23. Engagement of the ball 41 by a sleeve 12 forces it inwardly opening the aperture 23 for flow of pressure air therefrom.

It will be appreciated that it is not intended to limit the invention to the above example only, many variations, such as might readily occur to one skilled in the art, being possible, without departing from the scope thereof as defined by the appended claims.

For example there may be fewer channels than rows of apertures, each serving to supply pressure fluid to more than one row of apertures.

One or more of the channels may communicate with spaced circumferential passages within the thickness of the roller shell underlying the array of apertures.

What is claimed is:

1. A roller for a texturing press on a papermaking machine, said roller having an interchangeable engraved sleeve, said roller comprising a cylindrical shell having a plurality of axially and circumferentially spaced apertures in its peripheral surface through which pressurized air may be ejected, said cylindrical shell having an inner shell and an outer shell, said inner shell disposed within said outer shell, at least one axially extending channel within the thickness of the shell for supplying pressurized air to the apertures, means for supplying pressurized air to said at least one axially extending channel, at least one said axially extending channel defined by an axially extending groove in the surface of one of said inner and outer shells.

2. The roller according to claim 1 further comprising a plurality of axially extending channels, said apertures arranged in axially extending rows, each said channel supplying pressurized air to an axially extending row of apertures.

3. The roller according to claim 1 wherein said at least one axially extending groove is located in the outer peripheral surface of the inner roller shell.

4. The roller according to claim 1 wherein said at least one axially extending groove is in the inner peripheral surface of the outer roller shell.

5. The roller according to claim 1 wherein the roller shells are fitted together by thermally shrinking the outer shell onto the inner shell.

6. The roller according to claim 1 further comprising a resiliently outwardly loaded valve member operatively associated with each aperture to close the aperture, said valve members protruding from the surface of the roller whereby engagement of a sleeve with each valve member forces the valve members inwardly to open the apertures.

7. The roller according to claim 6 wherein each valve member is a ball.

8. The roller according to claim 6 wherein each valve member is urged outwardly by a compression spring.

9. The roller according to claim 1 wherein the sleeve is made of plastic with an outer cover of rubber, said cover having a laser engraved textured outer surface.

10. A texturing press for a papermaking machine having at least one roller according to claim 1.

11. A papermaking machine including a texturing press according to claim 10.

12. A method of texturing paper during its production on a papermaking machine wherein texture is imparted to the paper by a texturing press according to claim 10.

* * * * *